United States Patent [19]

Makino et al.

[11] Patent Number: 4,768,890

[45] Date of Patent: Sep. 6, 1988

[54] CARBON RIBBON TRANSPORT GUIDE DEVICE

[75] Inventors: Kazunosuke Makino, Tokyo; Yoshisada Takahashi, Iwate, both of Japan

[73] Assignee: Kabushiki Kaisha Sato, Japan

[21] Appl. No.: 57,760

[22] Filed: Jun. 3, 1987

Related U.S. Application Data

[63] Continuation of Ser. No. 774,295, Sep. 10, 1985, abandoned.

[30] Foreign Application Priority Data

Sep. 12, 1984 [JP] Japan ..... 59-137149

[51] Int. Cl.[4] ..... B41J 3/20; B41J 35/08

[52] U.S. Cl. ..... 400/120; 400/234; 400/248

[58] Field of Search ..... 400/224, 224.2, 234, 400/240.3, 245, 246, 248, 579, 618, 619, 120; 101/228, 336; 242/76; 226/180, 189, 190, 194, 199

[56] References Cited

U.S. PATENT DOCUMENTS

| | | | |
|---|---|---|---|
| 933,048 | 9/1909 | Barr | 400/639.1 X |
| 1,098,407 | 6/1914 | Roberts | 400/224.2 X |
| 2,029,996 | 2/1936 | Furman | 101/228 |
| 3,031,955 | 5/1962 | Gray | 101/336 X |
| 3,233,807 | 2/1966 | Wray | 226/180 |
| 3,930,446 | 1/1976 | Crissy | 101/228 X |
| 3,977,589 | 8/1976 | Gentile | 226/180 |
| 4,505,603 | 3/1985 | Yana | 400/120 |

FOREIGN PATENT DOCUMENTS

| | | | |
|---|---|---|---|
| 1140737 | 12/1962 | Fed. Rep. of Germany | 226/199 |

*Primary Examiner*—Charles Pearson

*Attorney, Agent, or Firm*—Ostrolenk, Faber, Gerb & Soffen

[57] ABSTRACT

An apparatus for guiding a carbon ribbon from a supply reel to a take-up reel includes an adjusting member which is used for securing a guide rod around which the carbon ribbon passes to a fixed plate. A bolt passes through an off-center hole in the adjusting member and upon tightening of the bolt, one end of the rod is secured to the fixed plate. The other end of the rod is pivotably secured in a base plate. Therefore, by turning the adjustment member, the location of the off-center hole is changed and the inclination of the rod is adjusted. By suitable setting of the adjustment member, the orientation of the rod is adjusted so that a uniform tension is applied across the ribbon tape to thereby prevent wrinkling or misalignment thereof.

4 Claims, 2 Drawing Sheets

CARBON RIBBON TRANSPORT GUIDE DEVICE

This is a continuation of application Ser. No. 774,295 filed on Sept. 10, 1985, now abandoned.

BACKGROUND OF THE INVENTION

The present invention relates to a transport guide device for guiding a carbon ribbon between a ribbon supply section and a ribbon take-up section, and more particularly to a carbon ribbon transport guide rod which is adjustable to apply a uniform tension across the width of the carbon ribbon.

Generally, carbon ribbon transport guide devices for use in thermal transfer or impact type printers include fixed guide rods, rotatable guide rods and guide plates which guide the ribbon from a supply section to a printing section and then to a ribbon take-up section. The ribbon is tensioned appropriately by mechanical loads applied to it both on the ribbon supply side and on the take-up side.

However, particularly with very wide ribbons, slight differences in tension develop across the width of the ribbon, causing wrinkling, misalignment and improper guidance of the ribbon.

Elimination of such wrinkling and misguidance of the ribbon requires delicate adjustment of the various ribbon guide rods of the ribbon supply and take-up sections. The adjustment is quite complex and considerable training is required for it.

SUMMARY OF THE INVENTION

It is an object of the present invention to provide a carbon ribbon transport guide device which permits easy adjustment of the tension at each side of the ribbon to prevent wrinkling and misguidance of the ribbon.

To attain the above object, the present invention comprises an adjusting member for adjusting the inclination of a ribbon guide rod across which the ribbon travels. Through inclination adjustments, the tension which the rod applies to the ribbon can be varied until a position is found at which the tension across the entire width of the ribbon becomes uniform. To this end, the adjusting member has an offset, i.e. eccentric fixing hole through which a retainer passes for securing one end of the ribbon guide rod to a fixed plate of the transport guide device. By rotating the adjusting member, the position of the eccentric hole with respect to the plate changes, for changing the inclination of the rod with respect to the plate. The tension at either end of the ribbon is thereby adjustable.

DESCRIPTION OF THE PREFERRED EMBODIMENT

An embodiment of the carbon ribbon transport guide device according to the present invention is now described with reference to the drawings which show the invention in a non limiting embodiment of a thermal transfer type printer.

Figure 1:
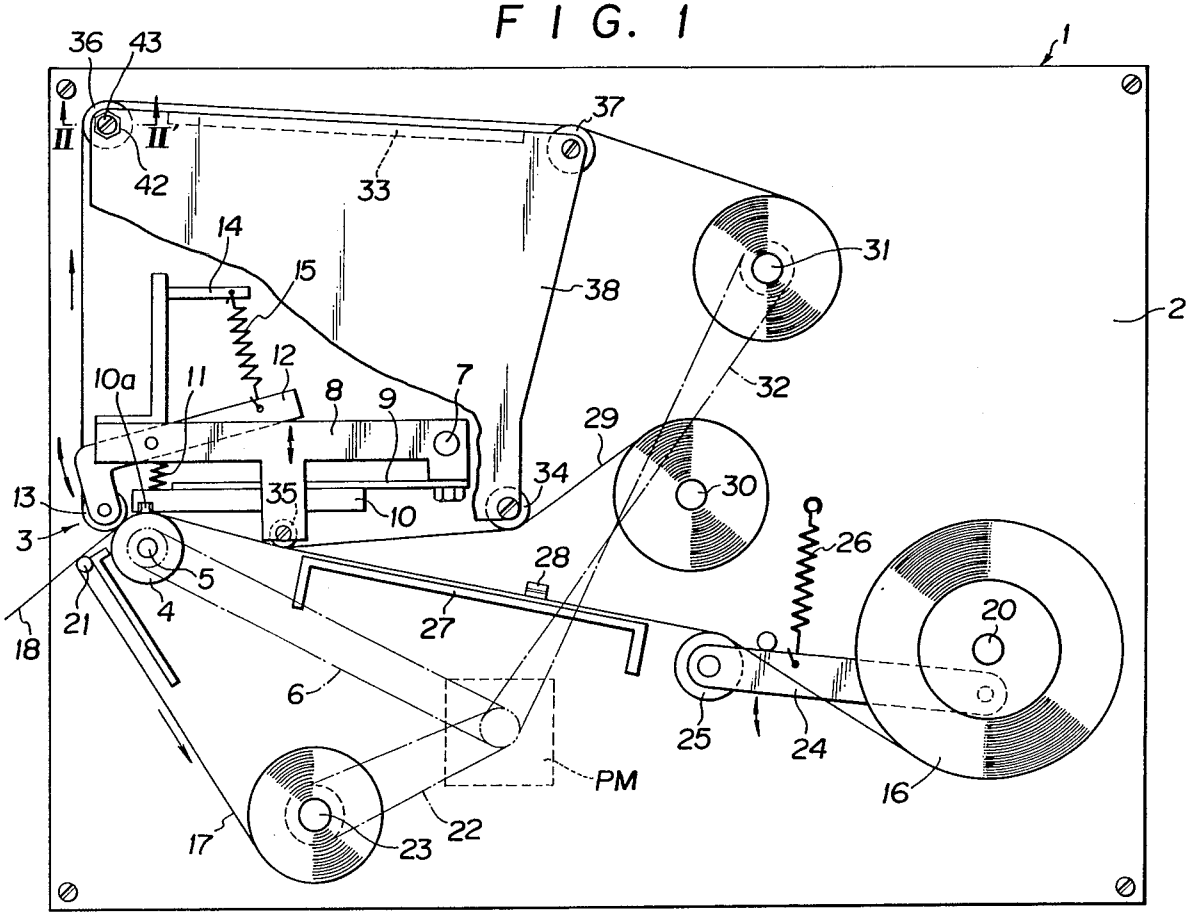
FIG. 1 is a plan view of a printer including an embodiment of a carbon ribbon transport device according to the present invention.

As illustrated in FIG. 1, a printer unit 1 is provided with a plate 2 on which a printing section 3, primarily comprising a platen 4 and heat sensitive head 10, is located.

The platen 4 of the printing section 3 is in the form of a roller that is rotatably supported on the plate 2 by means of its shaft 5. Platen 4 is rotated by a pulse motor PM, via a belt 6. Opposite the platen 4 is a head support 8, which is pivotally attached to the plate 2 by a pivot 7. A heat sensitive head 10 is attached to head support 8 via a strip spring 9. A compressed spring 11 disposed between the head support 8 and the heat sensitive head 10 urges the heating portion 10*a* of the heat sensitive head 10 into pressure contact with the platen 4.

Head support 8 is provided with a pair of symmetrically opposed, independently pivotable, support levers 12. The end of each lever 12 supports a rotatable follower roller 13. A pair of springs 15 are disposed between support levers 12 and a pair of pins 14 that are located on the head support 8. Springs 15 are tensioned to urge the follower roller 13 into pressure contact with the platen 4. Head support 8 may be turned clockwise, as shown by the arrow of FIG. 1, to facilitate the loading of a below-described label strip 16 and carbon ribbon 29 therethrough. During a printing operation, the head support 8 is fixed by a fixing mechanism, not shown, at an angle whereby the heat sensitive head 10 and the follower roller 13 are brought into pressure contact with the platen 4.

A label supply portion 20 is rotatably mounted on the plate 2 and is adapted to rotate while being subjected to a suitable mechanical load. Label supply portion 20 holds a reel of label strip 16 having the form of a printing paper which consists of a flexible support layer 17 to which a large number of contiguous labels 18 are temporarily adhered. After label strip 16 passes between the platen 4 and the heat sensitive head 10 and then past follower roller 13, a label separating pin 21 turns only the support 17 sharply through an approximately right-angle to separate the labels 18 from the support 17. The support 17 from which the labels 18 have been separated is reeled up by a support take-up portion 23 that is driven by the pulse motor via a belt 22.

The transported label strip 16 is suitably tensioned by a tension roller 25 which is rotatably mounted on a support arm 24. Support arm 24 is, in turn, pivotably attached to the plate 2, and a spring 26 urges the tension roller 25 against the label strip 16. A guide plate 27 guides the label strip 16 and provides a base on which a photoelectric detector 28 is disposed at one side thereof to detect each of the labels 18.

Plate 2 also supports a ribbon supply section 30 which is able to rotate while being mechanically loaded and which supports a reel of thermal transfer type carbon ribbon 29. The carbon ribbon 29 from the ribbon supply section 30 is guided to a superimposed position over the label strip 16 so that they pass together between the platen and both the heat sensitive head 10 and follower roller 13. Later, the carbon ribbon 29 is taken up on the ribbon take-up section 31. Ribbon take-up section 31 is rotatably mounted on the plate 2 and is also rotated by the pulse motor PM via a belt 32.

As the carbon ribbon 29 travels from the ribbon supply section 30 to the ribbon take-up section 31, it is guided along a guide plate 33 and around ribbon guide rods 34, 35, 36 and 37. The guide plate 33 includes an integrally formed fixing plate 38 which extends generally a predetermined distance away from and in parallel to the plate 2. Ribbon guide rods 34 and 37 are secured by screws between plate 2 and fixing plate 38 and provide supports therebetween. Ribbon guide rod 35 is also secured by a screw to retain its position with respect to head support 8. The rod 35 is located at a position where the carbon ribbon 29 and the label strip 16 meet and are superimposed over each other.

In a manner similar to rods 34 and 37, ribbon guide rod 36 is also fixed between plate 2 and fixing plate 38, except that it is also provided with means for adjusting the tension at the two edges of the carbon ribbon 29 which passes over it. The tension adjusting means are explained below with reference to FIGS. 2 to 4.

Figure 2:
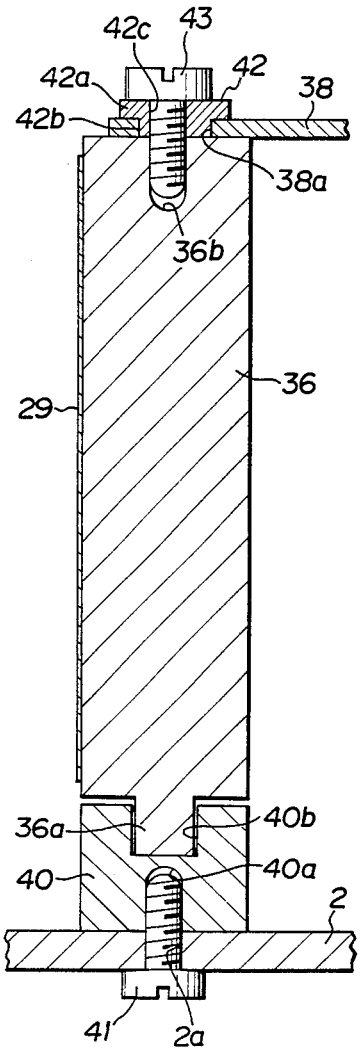
FIG. 2 is a cross-sectional view through line II—II in FIG. 1.

As shown in FIG. 2, the lower end of the rod 36 in that Figure is supported by a pillar-shaped bearing member 40 which has a threaded hole **40*a* formed along the lower part of its axis and a bearing inset 40*b* formed along the upper part of its axis. Bearing member 40 is fixed to the plate 2 by a bolt 41 which passes through the hole 2*a* formed in the plate 2 and which screws into threaded hole 40*a*. The rod 36 has a round-shaped engaging portion 36*a* formed integrally along its lower axis, and the portion 36*a* fits into the inset 40*b* of the bearing member 40**.

An adjusting member 42 is provided at the top end of ribbon guide rod 36. The adjusting member 42 includes a hexagonal operating portion **42*a* at the top and a circular free-fit portion 42*b* therebelow which fits into a round fixing hole 38*a* provided in plate 38. Therefore, adjusting member 42 can be turned relative to the fixing plate 38. An axially eccentric through-hole 42*c* is located slightly off the center of the circular free-fit portion 42*b***.

A bolt 43 passes through the through-hole **42*c* of adjusting member 42 and screws into the threaded hole 36*b* located along the top of the central axis of rod 36. Bolt 43 secures ribbon guide rod 36, fixing plate 38 and adjusting member 42** to each other.

The rod 36 is supported between plate 2 and fixing plate 38. The inclination of the rod can be altered by the turning adjusting member 42, as explained below.

Operation of the pulse motor PM transports the label strip 16 and carbon ribbon 29 between the platen 4 and the follower roller 13. Thereafter, the support 17 of the label strip 16 is taken up by the support take-up portion 23, and the carbon ribbon 29 is taken up by the ribbon take-up section 31. While the label strip 16 and carbon ribbon 29 are being transported, the desired information is printed on the labels by the heating portion **10*a* of the heat sensitive head 10**.

The carbon ribbon 29 is guided in part by ribbon guide rods 34, 35, 36 and 37. However, slight adjustment differences in the conditions of the supply, the guide, and the take-up means can cause variations in the tension that is applied across the width of the carbon ribbon 29 so that one side is tensioned more than the other. This may cause wrinkling of the section of the ribbon where less tension is applied, producing a crooked carbon ribbon 29.

Figure 4:
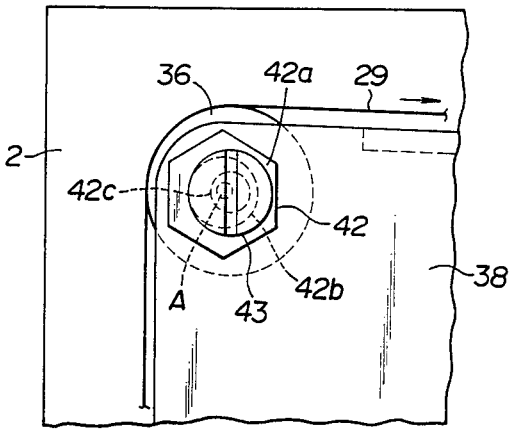
FIGS. 3 and 4 are plan views of the adjusting member of the device which show different positions thereof to facilitate understanding of the present invention.
Figure 3:
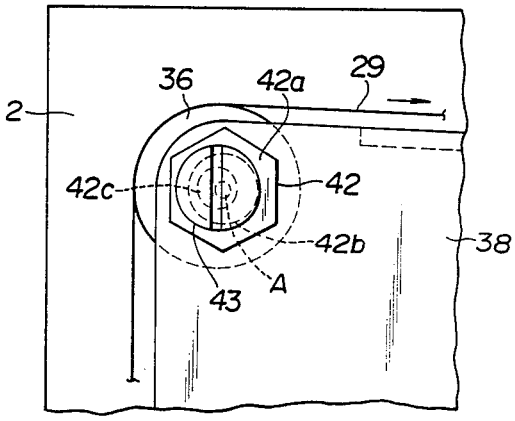

However, in accordance with the present invention, by loosening the bolt 43, turning the adjusting member 42 to a desired degree and then retightening the bolt 43, the tension across the width of the carbon ribbon 29 can be equalized. This is enabled because through-hole **42*c* of the adjusting member 42 is located at an off-center position so that when adjusting member 42 is turned, through-hole 42*c* and the bolt 43 turn through a circular path A, as shown in FIGS. 3 and 4, which selectively alters the inclination of rod 36 with respect to the plate 2. Referring to FIG. 3, if for example the tension at the lower part A of the carbon ribbon 29 is higher than that at the upper part B thereof, through-hole 42*c* is rotated such that the rod 36, moves outwardly toward the ribbon 29. If the tension at the upper part is higher, adjusting member 42 is turned the other way to move the through-hole 42*c* away from the carbon ribbon 29 as shown in FIG. 4**.

In the above embodiment, bolt 43 comprises the means for fixing the adjusting member 42 to the ribbon guide rod 36. As shown, bolt 43 is screwed into the threaded hole **36*b* in the ribbon guide rod 36. Alternately, a bolt may be formed integrally with the ribbon guide rod 36 along the upper axis thereof. The bolt has the form of a stud which passes through the hole 42*c*. A nut would then be provided for tightening the adjusting member 42. Further, instead of the bearing member 40 which is used as the support at the lower end of the ribbon guide rod 36, rod 36 may be bolted directly to the plate 2. In this case, the inner diameter of the hole 2*a* in the plate 2 would need to be somewhat larger than the diameter of the bolt to permit the rod 36 to tilt with respect to the plate 2. Finally, although the above embodiment shows the adjusting member 42 to be located at the top end of the ribbon guide rod 36, it is possible to form the device so that the adjustment is carried out at the lower part of the ribbon guide rod 36**, or selectively at both the lower part and the upper part thereof.

As described above, in accordance with the invention, an adjusting member is provided which has an off-center fixing hole through which a bolt used as a fastening means passes. By rotating the adjustment altering member the inclination of the ribbon guide rod is altered, thus controlling the degree of tension on the two edges of the carbon ribbon. Consequently, ribbon wrinkling and improper guidance of the ribbon are prevented.

Although the present invention has been described by reference to specific embodiments thereof, many modifications, variations and other uses will now become apparent to those skilled in the art. It is preferred therefore that the present invention be limited not by the specific embodiments disclosed herein, but only by the appended claims.

What is claimed is:

1. In combination, a tension adjusting device for a carbon ribbon transport guide, the device comprising:

a ribbon guide rod around which a carbon ribbon is guided; the rod having axially opposite first and second ends; means for guiding a carbon ribbon under tension around the rod without pinching the ribbon against the rod wherein the ribbon may slide on the rod;

a support member at the first rod end and having a through hole therein;

an adjusting member having a portion which is mounted to and rotatable in the through hole of the support member, the adjusting member further having an off-center hole therethrough, which is eccentric of the center of rotation of the adjusting member in the through hole;

securing means which pass through the off-center hole of the adjusting member and which engage the first rod end for securing the rod to the adjusting member; and a second support at the second rod end for supporting the rod to permit it to be inclined with respect to the second support, such that by rotating the adjusting member, the location of the first end of the rod with respect to the support member can be altered to adjust the tilt of the rod with respect to the support member and the second support, to adjust the tension gradient of the ribbon and thereby apply a uniform tension across the ribbon; and a printer ribbon transport mechanism, comprising:

a thermal printing head;

ribbon supply means for supplying ribbon to the printing head;

ribbon take-up means for taking up the ribbon after it passes the printing head;

a plurality of supporting rods positioned to support and guide the ribbon as it travels to and from the printing head; the ribbon guide rod being one of the supporting rods;

a printable medium; and means for moving that medium to the printing head for that medium to be imprinted by the carbon ribbon;

and further comprising guide plate means including a guide plate generally parallel to said ribbon, and disposed adjacent the guide rod for guiding the ribbon after it passes around the ribbon guide rod.

2. A device as in claim 1, wherein said support member at said first rod end comprises a fixing plate for supporting each of said plurality of supporting rods, said guide plate being integral with and depending from said fixing plate and extending along the path of said ribbon after it passes around the ribbon guide rod.

3. A device for adjusting a carbon ribbon transport guide to apply a uniform tension across the ribbon, the device comprising:

a ribbon guide rod around which a carbon ribbon is guided; the rod having axially opposite first and second ends; means for guiding a carbon ribbon under tension around the rod without pinching the ribbon against the rod wherein the ribbon may slide in the rod;

a support member at the fist rod end, having a through-hole therein;

an adjusting member having a portion which is mounted to and rotatable in the through-hole of the support member, the adjusting member further having an off-center hole therethrough, which is eccentric with respect to the center of rotation of the adjusting member in the through-hole; and securing means for engaging the off-center hole of the adjusting member and the first rod end, to secure the rod to the adjusting member; and second support means at the second rod end for tiltably supporting the rod to permit it to be inclined with respect to the second support means, such that by rotating the adjusting member, the location of the firsit end of the rod with respect to the support member can be altered to adjust the tilt of the rod with respect to the support member and the second support means, to adjust the tension gradient of the ribbon and thereby apply a uniform tension across the ribbon;

in which the adjusting member comprises an operating portion having a transverse cross-section which is wider than the dimension of the through-hole of the support member;

in which the securing means comprises a bolt having a threaded shaft which passes through the off-center hole, the threaded shaft being threadedly received in the first end of the first rod; and in which the second support means for tiltably supporting the second end of the rod comprises a bearing having a bearing inset therein which faces the second end of the rod, the rod further comprising a protrusion from the second end which rests in the bearing inset, the bearing inset being sufficiently large to permit the pivoting of the rod with respect to the bearing;

and further comprising guide plate means including a guide plate generally parallel to said ribbon, and disposed adjacent the guide rod for guiding the ribbon after it passes around the ribbon guide rod.

4. A device as in claim 3, wherein said support member at said first rod end comprises a fixing plate for supporting said ribbon guide rod, said guide plate being integral with and depending from said fixing plate and extending along the path of said ribbon after it passes around the ribbon guide rod.

* * * * *